US008953004B2

(12) United States Patent
Arima

(10) Patent No.: US 8,953,004 B2
(45) Date of Patent: Feb. 10, 2015

(54) IMAGE ERASING APPARATUS

(71) Applicants: Kabushiki Kaisha Toshiba, Tokyo (JP); Toshiba Tec Kabushiki Kaisha, Tokyo (JP)

(72) Inventor: Yasuharu Arima, Shizuoka-ken (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/054,294

(22) Filed: Oct. 15, 2013

(65) Prior Publication Data

US 2014/0192126 A1 Jul. 10, 2014

(30) Foreign Application Priority Data

Jan. 9, 2013 (JP) ..... 2013-001532

(51) Int. Cl.
*B41J 2/32* (2006.01)
*B41J 2/475* (2006.01)
*B41M 7/00* (2006.01)

(52) U.S. Cl.
CPC ..... *B41J 2/475* (2013.01); *B41M 7/0009* (2013.01); *B41M 7/009* (2013.01)
USPC ..... 347/179

(58) Field of Classification Search
USPC ..... 347/171, 179
See application file for complete search history.

(56) References Cited

U.S. PATENT DOCUMENTS

| | | | | |
|---|---|---|---|---|
| 8,292,287 | B2 * | 10/2012 | Iguchi et al. | 271/9.08 |
| 8,550,448 | B2 * | 10/2013 | Iguchi et al. | 271/9.08 |
| 2011/0074086 | A1 | 3/2011 | Iguchi et al. | |
| 2011/0222131 | A1 | 9/2011 | Yahata et al. | |
| 2012/0306985 | A1 | 12/2012 | Iguchi et al. | |
| 2013/0015623 | A1 | 1/2013 | Iguchi et al. | |

FOREIGN PATENT DOCUMENTS

| | | |
|---|---|---|
| JP | 07-239630 | 9/1995 |
| JP | 2012252312 A | 12/2012 |

OTHER PUBLICATIONS

Japanese Office Action dated Nov. 18, 2014, filed in Japanese counterpart Application No. 2013-001532, 6 pages (with translation).

* cited by examiner

*Primary Examiner* — Huan Tran
(74) *Attorney, Agent, or Firm* — Patterson & Sheridan, LLP

(57) ABSTRACT

According to an embodiment, an image erasing apparatus that erases an image printed on a sheet is provided. When it is determined that a sheet after an erasing process of the image is not reusable, the image erasing apparatus accommodates the sheet in a reject tray in a state where a face with a small information amount of the erased image is directed in a state direction. When it is determined that the sheet after the erasing process of the image is not reusable, the image erasing apparatus accommodates the sheet in a reuse tray in a state where a face with a large information amount of the erased image is directed in the state direction.

10 Claims, 4 Drawing Sheets

IMAGE ERASING APPARATUS

CROSS-REFERENCE TO RELATED APPLICATION

This application is based upon and claims the benefit of priority from the prior Japanese Patent Application No. 2013-001532, filed on Jan. 9, 2013, the entire contents of which are incorporated herein by reference.

FIELD

Embodiments described herein relate generally to an image erasing apparatus that erases an image formed on a recording medium.

BACKGROUND

Conventionally, a device having a function of erasing an image such as a character, a picture, and a photograph printed on a recording medium such as a sheet is proposed. For example, an image forming device obtained by adding an erasing function of erasing an image printed on a sheet to an image forming device having an image forming function of printing an image on a recording medium such as a sheet is proposed. In addition, an image erasing apparatus having only the erasing function is provided. Hereinafter, the image forming device and the image erasing apparatus are collectively called an image erasing apparatus. The image erasing apparatus includes a scanner unit, a storage unit, and an erasing unit. The scanner unit scans a sheet, and converts a result of the scanning into electronic data, before erasing the image on the sheet. The storage unit stores the electronic data of the result of the scanning. The erasing unit performs an erasing process on the sheet based on the result of the scanning. For example, the image erasing apparatus determines whether there is an image to be erased on the sheet based on the result of the scanning. In addition, the image erasing apparatus determines whether the sheet itself is a reusable sheet with no wrinkling or the like based on the result of the scanning. When there is the image to be erased on the sheet and the sheet itself is reusable, the erasing unit performs the erasing process on the sheet.

In addition, the scanner unit scans the sheet after the erasing process is performed by the erasing unit. The image erasing apparatus automatically determines whether the image on the sheet is erased based on the result of the scanning. The image erasing apparatus has a reject tray and a reuse tray as a discharge tray. When it is determined that the image on the sheet is erased and the sheet is reusable, the image erasing apparatus discharges the erasing-processed sheet to the reuse tray. When it is determined that the image on the sheet is not erased, the image erasing apparatus discharges the erasing-processed sheet to the reject tray. Meanwhile, in an erasing process target sheet, printing information may be only on one face (printing may be performed on one face). When the one-side printed image is not erased, the image erasing apparatus may discharge the one-side printed sheet to the reject tray, with the other face on which the image has not been originally printed being upward. When the sheet is discharged to the reject tray with the face on which the image has not been originally printed being upward, a user may mistake the reject tray as the reuse tray.

DETAILED DESCRIPTION

Figure 1:
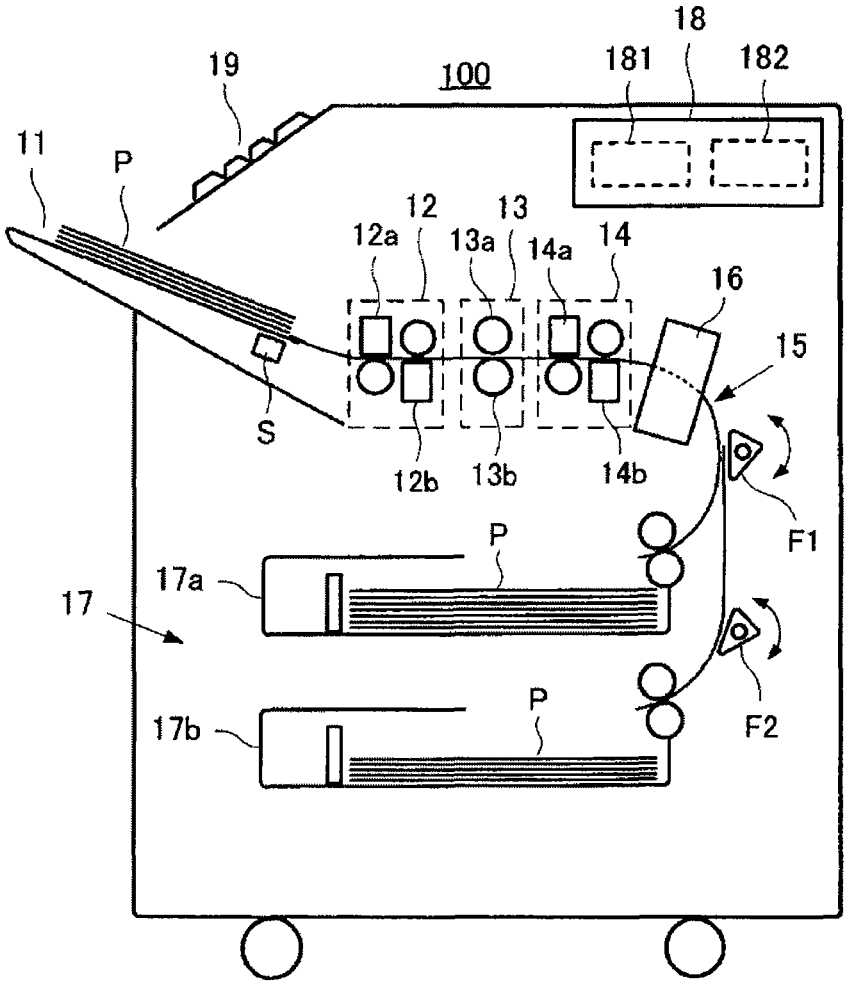
FIG. 1 is a cross-sectional view illustrating main units of an image erasing apparatus according to a first embodiment.

According to an embodiment, an image erasing apparatus that erases an image formed on a sheet is provided. The image erasing apparatus includes an erasing unit, a reading unit, a stack unit, a reversion unit, and a control unit. The erasing unit erases an image printed on a face of a sheet. The reading unit reads information of the face of the sheet. The stack unit accommodates the sheet on which an erasing process has been performed by the erasing unit. The reversion unit reverses the face of the erasing-processed sheet before the sheet is accommodated by a discharge tray. The control unit determines an erasing state of the image on the face of the sheet based on information of the face of the sheet read by the reading unit, and controls the reversion unit to reverse the face of the sheet according to the determined erasing state of the image.

Hereinafter, embodiments will be further described with reference to the drawings. In the drawings, the same sign represents the same or similar portion.

Figure 2:
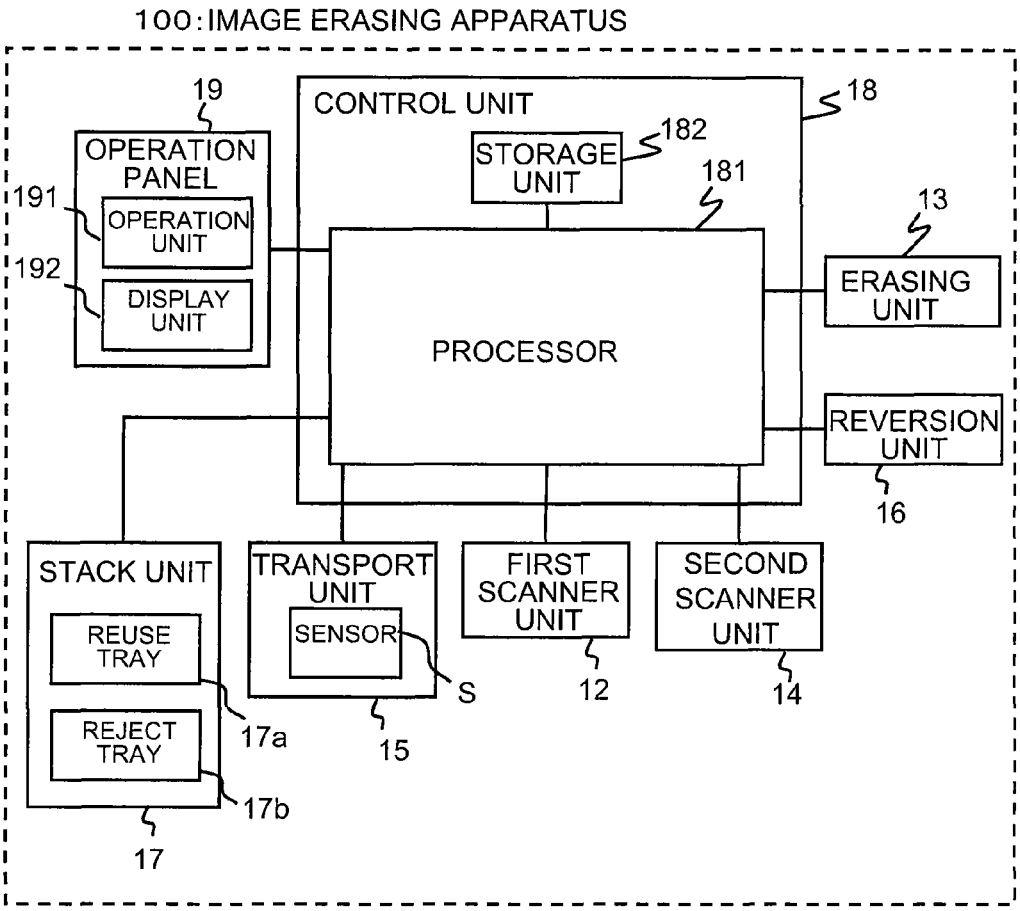
FIG. 2 is a block diagram illustrating a control configuration of the image erasing apparatus according to the first embodiment.

A first embodiment will be described with reference to FIG. 1 and FIG. 2. FIG. 1 is a cross-sectional view illustrating main units of an image erasing apparatus 100 according to the first embodiment. FIG. 2 is a block diagram illustrating a control configuration in the image erasing apparatus 100.

The image erasing apparatus 100 has a function of erasing an image such as a character, a picture, and a photograph printed on a recording medium such as a sheet. The image erasing apparatus 100 may be an image forming device having an image forming function of selecting, for example, an erasable color material or a non-erasable color material, and printing an image on a recording medium such as a sheet.

As illustrated in FIG. 1, the image erasing apparatus 100 includes a sheet feed tray 11 that is a sheet inlet, a first scanner unit 12, an erasing unit 13, a second scanner unit 14, a transport unit 15, a reversion unit 16, a stack unit 17, a control unit 18, and an operation panel 19.

The sheet feed tray 11 stacks an erasing process target sheet P in a predetermined stack direction. The predetermined stack direction is an upper direction in FIG. 1. The sheet feed tray 11 has a sensor S that detects whether the sheet P is stacked.

The first scanner unit 12 scans a face of the sheet P, reads information on the sheet face, and converts the read information into electronic data. The first scanner unit 12 has charge coupled device (CCD) sensors 12*a* and 12*b* that are image capturing elements to simultaneously scan both faces of the sheet P. The sensors 12*a* and 12*b* are disposed symmetrically up and down with a transport path of the sheet P interposed therebetween. The sensor 12*a* is opposed to one face P1 of the sheet P transported on the transport path, and scans the sheet face P1. The sensor 12*b* is opposed to the other face P2 of the sheet P transported on the transport path, and scans the sheet face P2.

The erasing unit 13 heats the image on the sheet P at a predetermined temperature (hereinafter, referred to as an erasing temperature) to erase the image on the sheet P on which the scanning process has been performed by the first scanner unit 12. The erasing unit 13 includes a pair of heating rollers 13*a* and 13*b* to simultaneously heat the images on the both faces of the sheet P. Each of the heating rollers 13*a* and 13*b* has therein a heater that is a heat source. The heating rollers 13*a* and 13*b* are opposed with the transport path of the sheet P interposed therebetween. The heating rollers 13*a* and 13*b* come in contact with both faces of the sheet P transported on the transport path, respectively. The erasing unit 13 erases the image on the sheet P when the image printed on the sheet P is formed using a color material which is erased (hereinafter, referred to as an erasable color material) by heating at the erasing temperature. The erasable color material includes, for example, a color compound, a developer, and a decolorant. The color compound may be, for example, leuco dye. The developer may be, for example, phenols. The decolorant may be, for example, a material which is compatible with the color compound when the material is heated and has no affinity with the developer. The erasable color material is colored by interaction between the color compound and the color developer, and the interaction between the color compound and the color developer is cut off by heating at a temperature equal to or higher than a decoloring temperature, and thus is decolored.

The second scanner unit 14 scans both faces of the sheet P on which the erasing process has been performed by the erasing unit 13, reads the information of the sheet face, and converts the read information into electronic data. The second scanner unit 14 is configured similarly to the first scanner unit 12. Specifically, the second scanner unit 14 includes CCD sensors 14*a* and 14*b* that are image capturing elements to simultaneously scan both faces of the sheet P. The sensors 14*a* and 14*b* are opposed symmetrically up and down with the transport path of the sheet P interposed therebetween. The sensor 14*a* is opposed to one face P1 of the sheet P transported on the transport path, and scans the sheet face P1. The sensor 14*b* is opposed to the other face P2 of the sheet P transported on the transport path, and scans the sheet face P2.

The first and second scanner units 12 and 14 are not limited to the CCD sensors as the image capturing elements, and may include complementary metal oxide semiconductor (CMOS) sensors.

The transport unit 15 includes flappers F1 and F2, a transport roller (not illustrated), a transport belt, and a driving motor that drive them. The transport path of the sheet P based on the transport unit 15 is directed from the sheet feed tray 11 to the stack unit 17, and has a substantially U shape. The transport unit 15 transports the sheet P stacked on the sheet feed tray 11 in order of the first scanner unit 12, the erasing unit 13, the second scanner unit 14, and the reversion unit 16.

The reversion unit 16 is disposed at a downstream position in a transport direction of the sheet P from the second scanner unit 14, and at an upstream position in the transport direction of the sheet P from the stack unit 17. The reversion unit 16 reverses the face of the sheet P transported on the transport path according to a control of the control unit 18 to be described later. For example, the sheet P is stacked in a state where one sheet face P1 (the other sheet face P2) is directed upward (downward) in FIG. 1 in the sheet feed tray 11. When the reversion unit 16 is not operated, the sheet P stacked on the sheet feed tray 11 is transported by the transport unit 15 such that the sheet P1 is opposed to the CCD sensor 12*a*, the heating roller 13*a*, and the CCD sensor 14*a* since the transport path of the sheet P has the substantially U shape, and the sheet P is finally discharged to a reuse tray 17*a* or a reject tray 17*b* of the stack unit 17 in a state where the sheet face P1 is directed downward in FIG. 1. In addition, the sheet P stacked on the sheet feed tray 11 is transported by the transport unit 15 such that the sheet face P2 is opposed to the CCD sensor 12*b*, the heating roller 13*b*, and the CCD sensor 14*b*, and is finally discharged to the reuse tray 17*a* or the reject tray 17*b* of the stack unit 17 in a state where the sheet face P2 is directed upward in FIG. 1. Meanwhile, when the reversion unit 16 is operated, the sheet P is discharged to the reuse tray 17*a* or the reject tray 17*b* of the stack unit 17 in a state where the sheet face P1 is directed upward in FIG. 1 and in a state where the sheet face P2 is directed downward in FIG. 1. In other words, when the sheet P is discharged to the reuse tray 17*a* or the reject tray 17*b* in the state where the sheet P1 is directed upward in FIG. 1 and in the state where the sheet face P2 is directed downward in FIG. 1, the reversion unit 16 is operated according to a control of the control unit 18 to be described later to reverse the sheet faces P1 and P2 of the sheet P. The reversion unit 16 includes the known reversion mechanism to reverse the face of the sheet P.

The stack unit 17 stacks the sheet P discharged through the first scanner unit 12, the erasing unit 13, the second scanner unit 14, and the reversion unit 16 in a predetermined stack direction and accommodates the sheet P. The predetermined stack direction is an upper direction in FIG. 1 similarly to the case of the sheet feed tray 11 described above. Hereinafter, the predetermined direction is referred to as an upper direction. The stack unit 17 includes the reuse tray 17*a* and the reject tray 17*b* to accommodate the sheet P. The reuse tray 17*a* accommodates the sheet P from which the image is erased and which is determined to be reusable by the control unit 18 to be described later. The reject tray 17*b* accommodates the sheet P from which the image is not erased or which is determined not to be reusable by the control unit 18 to be described later. The flappers F1 and F2 distribute the sheet P to the reuse tray 17*a* or the reject tray 17*b*. The flappers F1 and F2 swing according to a control of the control unit to be described later to distribute the sheet P. FIG. 1 illustrates that the flapper F1 swings counterclockwise and the flapper F2 swings clockwise to distribute the sheet P to the reject tray 17*b*.

The control unit 18 overall controls the operation of the image erasing apparatus 100. As illustrated in FIG. 2, the control unit 18 includes a processor 181 that is an operation processing unit (for example, a central processing unit (CPU)), and a storage unit 182 that is configured by volatile and nonvolatile memories.

The processor 181 performs various processes in the image erasing apparatus 100. In addition, the processor 181 executes a program stored in the storage unit 182 to realize various functions. For example, the processor 181 operates the first scanner unit 12 to scan the non-erasing-processed sheet P by the first scanner unit 12. The processor 181 controls the heater of the erasing unit 13 to power on such that the heating temperature based on the heating rollers 13*a* and 13*b* is the erasing temperature, and heats the image on the sheet P at the erasing temperature by the heating rollers 13*a* and 13*b* of the erasing unit 13. The processor 181 operates the second scanner unit 14 to scan the erasing-processed sheet P by the second scanner unit 14. The processor 181 determines the erasing states of the images of the sheet faces P1 and P2 and determines whether the sheet P is reusable, based the information of the sheet faces P1 and P2 read by scanning using the first and second scanner units 12 and 14. The processor 181 operates the reversion unit 16 based on the determination result of the erasing state of the image. In addition, the processor 181 operates the flappers F1 and F2 based on the determination result of the erasing state of the image and the determination result related to whether the sheet P is reusable. The processor 181 controls the operation of the image erasing apparatus 100 by an instruction of a user received by the operation panel 19.

The storage unit 182 includes, for example, a random access memory (RAM), a read only memory (ROM), a dynamic random access memory (DRAM), a static random access memory (SRAM), a video RAM (VRAM), and a hard disk drive (HDD).

The storage unit 182 stores various kinds of information and programs used in the image erasing apparatus 100. In addition, the storage unit 182 stores data and programs which have to be stored even when the power is turned off. In addition, the storage unit 182 stores the electronic data converted by the first scanner unit 12.

The function realized using the processor 181 and the storage unit 182 may be realized by mounting an application specific integrated circuit (ASIC).

The operation panel 19 includes an operation unit 191 and a display unit 192. The operation unit 191 includes a keyboard including a start key. The display unit 192 includes a touch panel display. The operation unit 191 receives a designation of parameters or an operation start instruction by a user in cooperation with the display unit 192. In addition, the display unit 192 displays a progress status of the erasing process performed by the erasing unit 13 and a state of the image erasing apparatus 100.

Figure 3:
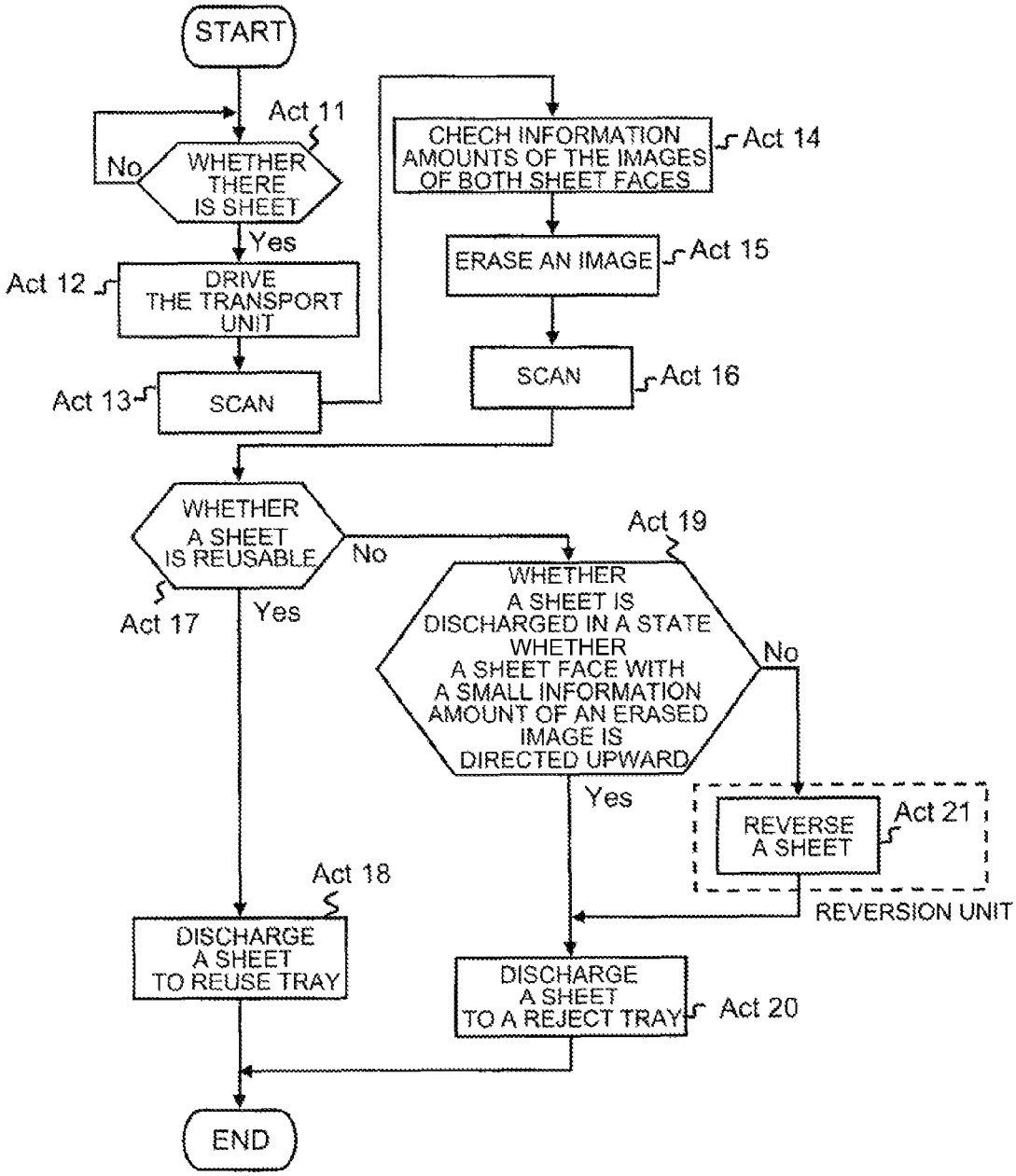
FIG. 3 is a flowchart illustrating a control operation of the image erasing apparatus according to the first embodiment.

FIG. 3 is a flowchart illustrating an example of a control operation of the image erasing apparatus 100 according to the first embodiment.

When the start key of the operation unit 191 receives an operation of the user, the operation of the image erasing apparatus 100 proceeds to Act 11. In Act 11, the processor 181 determines whether the sheet P is stacked on the sheet feed tray 11 based on the detection result from the sensor S. It is assumed that an image is printed on the sheet P using the erasable color material, and the following description is provided.

In Act 11, when the processor 181 determines that the sheet P is not stacked on the sheet feed tray 11, for example, the processor 181 causes the display unit 192 to display a message of urging the user to place the sheet P to the sheet feed tray 11, and waits that the sheet P is stacked on the sheet feed unit 11. When the processor 181 determines that the sheet P is stacked on the sheet feed tray 11, the operation of the image erasing apparatus 100 proceeds to Act 12. In Act 12, the processor 181 drives the transport unit 15 to control the transport unit 15 to transport the sheet P.

In Act 13, the processor 181 causes the transport unit 15 to transport the sheet P to the first scanner unit 12, and operates the first scanner unit 12. The first scanner unit 12 simultaneously scans the sheet faces P1 and P2 of the transported sheet P by the CCDs 12*a* and 12*b*, respectively. The first scanner unit 12 performs scanning to converts the information of the read sheet faces P1 and P2 into corresponding electronic data.

In Act 14, the processor 181 causes the storage unit 182 to store the electronic data corresponding to the information of the sheet faces P1 and P2. In addition, the processor 181 checks the information amounts of the images printed on the sheet faces P1 and P2 from the information of the sheet faces P1 and P2 read by the CCDs 12*a* and 12*b*, respectively.

In Act 15, the processor 181 causes the transport unit 15 to transport the sheet P to the erasing unit 13. The erasing unit 13 heats the images of the sheet P by the heating rollers 13*a* and 13*b* to erase the images on the sheet P.

In a waiting state where the image erasing apparatus 100 does not perform the erasing operation, the processor 181 controls the heaters of the heating rollers 13*a* and 13*b* to power on such that the heating temperatures of the heating rollers 13*a* and 13*b* are a predetermined waiting temperature. For example, when the predetermined waiting temperature is determined in advance to the erasing temperature, the erasing unit 13 can immediately perform the erasing process on the sheet P to be transported when the start key of the operation unit 191 receives an operation of the user. Accordingly, for example, in order to lower power consumption in the waiting state, when the predetermined waiting temperature is determined in advance to a temperature lower than the erasing temperature, the erasing unit 13 may not immediately perform the erasing process on the sheet P to be transported even when the start key of the operation unit 191 receives the operation of the user. In order for the erasing unit 13 to perform the erasing process on the sheet P, it is necessary to raise the heating temperature of the heating rollers 13*a* and 13*b* to the erasing temperature. Accordingly, the processor 181 monitors the heating temperature of the heating rollers 13*a* and 13*b* based on temperature detection information of a temperature sensor (not illustrated). The processor 181 determines that the heating temperature of the heating rollers 13*a* and 13*b* reaches the erasing temperature, and starts transporting of the sheet P from the sheet feed tray 11 by the transport unit 15. In addition, the processor 181 controls the erasing unit 13 such that the heating temperature of the heating rollers 13*a* and 13*b* is kept at the erasing temperature.

In Act 16, the processor 181 transports the sheet P to the second scanner unit 14 by the transport unit 15, and operates the second scanner unit 14. The second scanner unit 14 scans the sheet faces P1 and P2 of the sheet P transported from the erasing unit 13 by the CCDs 14*a* and 14*b*. The second scanner unit 14 performs scanning to convert the information of the read sheet faces P1 and P2 into corresponding electronic data. The processor 181 controls the storage unit 182 to store the electronic data corresponding to the information of the sheet faces P1 and P2.

In Act 17, the processor 181 determines the erasing state of the image and whether the sheet P is reusable based on the information (Act 16) of the non-erasing-processed sheet faces P1 and P2 stored in the storage unit 182 and the information (Act 14) of the erasing-processed sheet faces P1 and P2 stored in the storage unit 182. Specifically, for example, the processor 181 compares the information of the non-erasing-processed sheet faces P1 and P2 with the information of the sheet faces P1 and P2 after the erasing process. By the comparison, for example, the processor 181 calculates a difference (I1−I2) of the information amount (I2) of the images of the erasing-processed sheet faces P1 and P2 with respect to the information amount (I1) of the images of the sheet faces P1 and P2 before the erasing.

In addition, the processor 181 calculates a ratio (1−I2/I1) of the difference (I1−I2) of the information amount of the image with respect to the information amount (I1) of the images of the sheet faces P1 and P2 before the erasing. Hereinafter, the ratio (1−I2/I1) is referred to as the information amount of the erased image. When the information amount of the erased image of the sheet faces P1 and P2 after the erasing is larger than a predetermined threshold value, the processor 181 determines that the information amount of the erased image is large and the sheet P is reusable. When the information amount of the erased image of the sheet faces P1 and P2 after the erasing is smaller than the predetermined threshold value, the processor 181 determines that the information amount of the erased image is small and the sheet P is not reusable. The predetermined threshold value is stored in advance in the storage unit 182.

Meanwhile, on the erasing process target sheet P, an image may be printed only on any one sheet face of the sheet faces P1 and P2, or images may be printed on both sheet faces P1 and P2. Hereinafter, the sheet P in which the image is printed only on any one sheet face is referred to as one-face printed sheet P, and the sheet P in which the images are printed on both sheet faces P1 and P2 is referred to as both-face printed sheet P. The processor 181 determines whether the erasing process target sheet P is the one-face printed sheet P or the both-face printed sheet P by the check result in Act 14.

When the erasing process target sheet P is the one-face printed sheet P, there is no erasing target image on the sheet face on which an image has not been originally printed, and thus the processor 181 determines whether the sheet P is reusable by recognizing whether the information amount of the erased image is large or small on the sheet face on which the image is printed. The processor 181 determines that the sheet P is reusable when the information amount of the erased image is large, and determines that the sheet P is not reusable when the information amount of the erased image is small.

When the erasing process target sheet P is the both-face printed sheet, the processor 181 recognizes whether the information amount of the erased image is large or small in each of both sheet faces P1 and P2. The processor 181 may recognizes that the information amount of the erased image only on one sheet face is large, that the information amounts of the erased images of both sheet faces P1 and P2 are large, or that the information amounts of the erased images of both sheet faces P1 and P2 are small. In other words, the processor 181 may recognizes that any one sheet face of the sheet faces P1 and P2 is reusable, that both sheet faces P1 and P2 are reusable, and that both sheet faces P1 and P2 are not reusable. When it is recognized that only one sheet face of the sheet faces P1 and P2 is reusable, and when it is recognized that both sheet faces P1 and P2 are reusable, the processor 181 determines that the sheet P is reusable. In addition, when it is recognized that both sheet faces P1 and P2 are not reusable, the processor 181 determines that the sheet P is not reusable.

In addition, the processor 181 can determine whether the information amount of the erased image of any sheet face of the sheet faces P1 and P2 is larger and small. That the information amount of the erased image is large is that the information amount of the image remaining o the sheet face of the sheet P after the erasing is small, and that the information amount of the erased image is small is that the information amount of the image remaining on the sheet face of the sheet P after the erasing is large.

In Act 17, when the processor 181 determines that the sheet P is reusable (Yes), the operation of the image erasing apparatus 100 proceeds to Act 18. In Act 18, the processor 181 does not allow the reversion unit 16 to operate. The processor 181 allows the flapper F1 to swing clockwise. The flapper F1 guides the sheet P transported by the transport unit 15, and discharges the sheet P to the reuse tray 17*a*. The reuse tray 17*a* accommodates the discharged sheet P.

In Act 17, the processor 181 determines that the sheet is not reusable (No), the operation of the image erasing apparatus 100 proceeds to Act 19. In Act 19, the processor 181 determines whether the sheet P is discharged to the reject tray 17*b* in a state where the sheet face with the small information amount of the erased image is directed upward even when the reversion unit 16 is not operated based on the information (Act 16) of the erasing-processed sheet faces P1 and P2 stored in the storage unit 182. In other words, the processor 181 determines whether the sheet P is discharged to the reject tray 17*b* in a state where the sheet face with the small information amount of the erased image is directed in the stack direction.

When the erasing process target sheet P is the one-face printed sheet P, there is no erasing target image on the sheet face on which the image has not been originally printed, and thus the processor 181 determines that the sheet face on which the image is originally printed is the sheet face with the small information amount of the erased image. When the sheet face P2 is the face with the small information amount of the erased image, the processor 181 determines that the sheet P is discharged in a state where the face with the small information amount of the erased image is directed upward even when the reversion unit 16 is not operated. When the sheet face P1 is the face with the small information amount of the erased image, the processor 181 determines that the sheet P is not discharged in a state where the face with the small information amount of the erased image is directed upward if the reversion unit 16 is not operated.

When the erasing process target sheet P is the both-face printed sheet P, the processor 181 determines which one of the sheet faces P1 and P2 is the face with the small information amount of the erased image, based on the information of the sheet faces P1 and P2. Specifically, the processor 181 compares the information amount (1−I2/I1) of the erased image of the sheet P1 with the information amount (1−I2/I1) of the erased image of the sheet P2, and determines that the sheet face with the small information amount of the erased image is the face with the small information amount of the erased image. When the sheet face P2 is smaller than the sheet face P1 in terms of information amount of the erased image, the processor 181 determines that the sheet P is discharged in a state where the face with the small information amount of the erased image is directed upward even when the reversion unit 16 is not operated. When the sheet face P1 is smaller than the sheet face P2 in terms of information amount of the erased image, the processor 181 determines that the sheet P is not discharged in a state where the small information amount of the erased image is directed upward if the reversion unit 16 is not operated.

In Act 19, when the processor 181 determines that the sheet P is discharged in a state where the face with the small information amount of the erased image is directed upward (Yes), the operation of the image erasing apparatus 100 proceeds to Act 20. In other words, when the processor 181 determines that the sheet face P2 is the face with the small information amount of the erased image, the operation of the image erasing apparatus 100 proceeds to Act 20. In Act 20, the processor 181 does not allow the reversion unit 16 to operate. The processor 181 allows the flapper F1 to swing counterclockwise, and allows the flapper F2 to swing clockwise. The flappers F1 and F2 guide the sheet P transported by the transport unit 15, and discharges the sheet P to the reject tray 17*b*. The reject tray 17*b* accommodates the sheet P in a state where the face (the sheet face P2) with the small information amount of the erased image of the discharged sheet P is directed upward.

In Act 19, when the processor 181 determines that the sheet P is not discharged in a state where the face with the small information amount of the erased image is directed upward (No), the operation of the image erasing apparatus 100 proceeds to Act 21. In other words, when the processor 181 determines that the sheet face P1 is the face with the small information amount of the erased image, the operation of the image erasing apparatus 100 proceeds to Act 21. In Act 21, the processor 181 allows the reversion unit 16 to operate. The reversion unit 16 reverses the sheet faces P1 and P2. After the sheet P is reversed, the operation of the image erasing apparatus 100 proceeds to Act 20. In Act 20, the processor 181 allows the flapper F1 to swing counterclockwise, and allows the flapper F2 to swing clockwise. The flappers F1 and F2 guide the sheet P transported by the transport unit 15, and discharges the sheet P to the reject tray 17*b*. The reject tray 17*b* accommodates the sheet P in a state where the face (the sheet P1) with the small information amount of the erased image of the discharged sheet P is directed upward.

As described above, the image erasing apparatus 100 of the first embodiment accommodates the sheet P determined to be reusable in the reuse tray 17*a* based on the information of the sheet faces P1 and P2 read by scanning the sheet P. In addition, the image erasing apparatus 100 accommodates the sheet P determined not to be reusable in the reject tray 17*b* in a state where the sheet face with the small information amount of the erased image is directed upward (the stack direction) in FIG. 1. In the non-reusable sheet P accommodated in the reject tray 17*b*, the sheet face with the small information amount of the erased image is directed upward (the stack direction), and thus it is possible to prevent the user from erroneously reusing the non-reusable sheet P in the reject tray 17*b*.

In addition, since the image erasing apparatus 100 of the first embodiment scans both faces P1 and P2 of the sheet, it is possible to accommodate the sheet P in the reject tray 17*b* in a state where the sheet face with the small information amount of the erased image is directed upward (the stack direction) even when not only the one-face printed sheet P for the erasing process target sheet P is discharged to the reject tray 17*b*, but also the both-face printed sheet P is discharged to the reject tray 17*b*.

In addition, according to the image erasing apparatus 100 of the first embodiment, the user sees the sheet P accommodated in the reuse tray, and can recognize that the image of the sheet P could be erased. In addition, the user sees the sheet P accommodated in the reject tray, and can recognize that the image of the sheet P is not erased.

Figure 4:
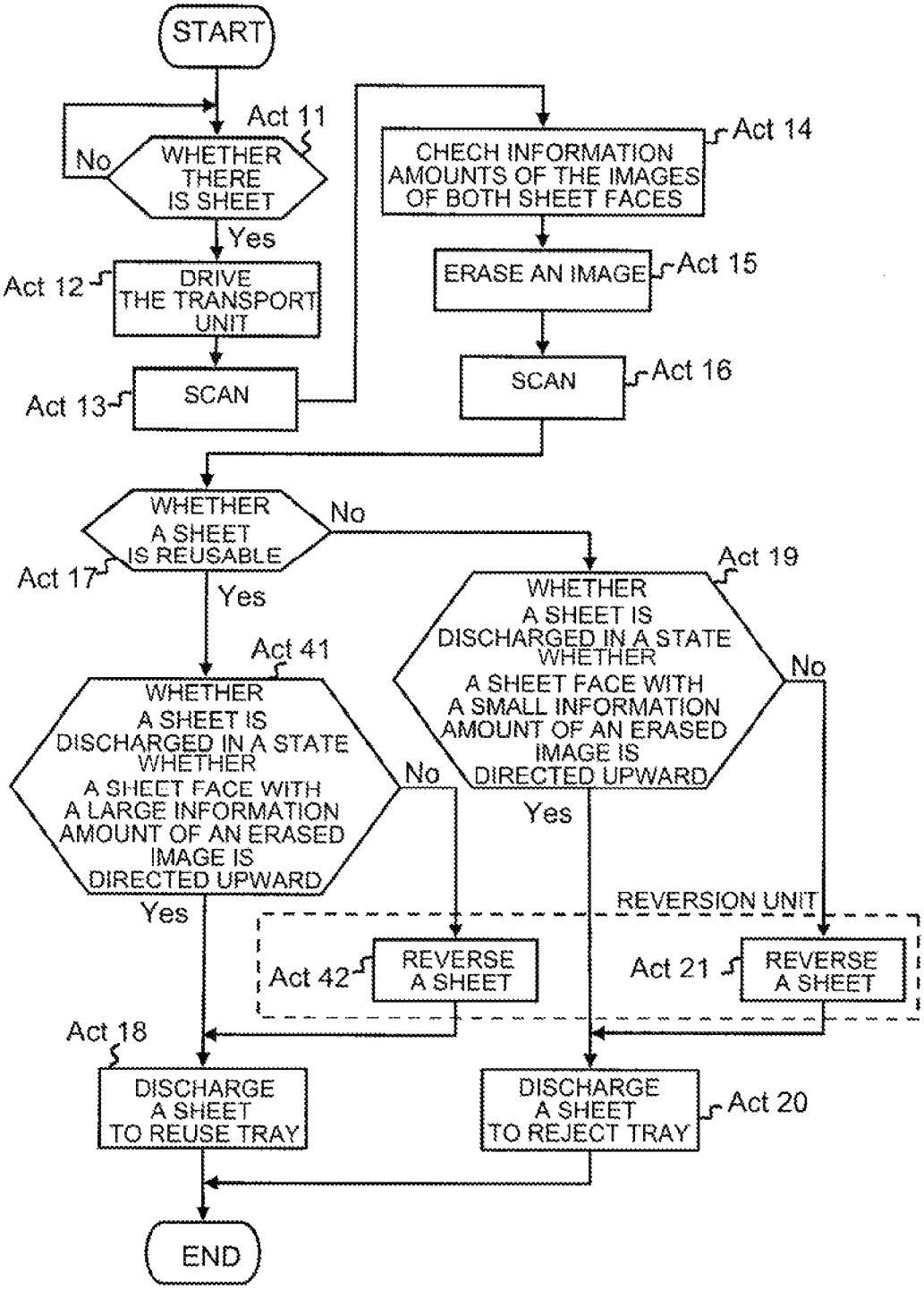
FIG. 4 is a flowchart illustrating a control operation of an image erasing apparatus according to a second embodiment.

FIG. 4 is a flowchart illustrating a control operation of an image erasing apparatus according to a second embodiment. An image erasing apparatus 100 according to the second embodiment has a configuration illustrated in FIG. 1 and FIG. 2, similarly to the first embodiment. In addition, in the flowchart of FIG. 4, with respect to the same operation as the flowchart of FIG. 3, the same sign is attached, and the detailed description is not provided.

As illustrated in FIG. 4, the image erasing apparatus 100 according to the second embodiment performs the operations of Acts 11 to 17. In Act 17, the processor 181 determines the erasing state of the image and whether the sheet P is reusable, based on the information (Act 16) of the non-erasing-processed sheet faces P1 and P2 stored in the storage unit 182 and the information (Act 14) of the erasing-processed sheet faces P1 and P2 stored in the storage unit 182.

In Act 17, when the processor 181 determines that the sheet P is not reusable (No), the operation of the image erasing apparatus 100 proceeds to Acts 19 and 20. Accordingly, when the face with the small erased print amount of the non-reusable sheet P is the sheet face P1, the sheet faces P1 and P2 of the sheet P are reversed by the reversion unit 16, and the sheet P is accommodated in the reject tray 17*b* in a state where the sheet face P1 is directed upward. In addition, when the face with the small erased print amount of the non-reusable sheet P is the sheet face P2, the sheet faces P1 and P2 are not reversed by the reversion unit 16, and the sheet P is accommodated in the reject tray 17*b* in a state where the sheet face P2 is directed upward.

In Act 17, when the processor 181 determines that the sheet P is reusable (Yes), the operation of the image erasing apparatus 100 proceeds to Act 41. In Act 41, the processor 181 determines whether the sheet P is discharged in a state where the sheet face with the large information amount of the erasable image is directed upward even when the reversion unit 16 is not operated based on the information (Act 16) of the erasing-processed sheet faces P1 and P2 stored in the storage unit 182.

When the erasing process target sheet P is the one-face printed sheet P, the processor 181 determines that the sheet face on which the image is originally printed is the sheet face with the large information amount of the erased image since there is no erasing target image on the sheet face on which the image is not originally printed. When the sheet face P2 is the sheet face with the large information amount of the erased image, the processor 181 determines that the sheet P is discharged in a state where the sheet face with the large information amount of the erased image is directed upward even when the reversion unit 16 is not operated. When the sheet face P1 is the sheet face with the large information amount of the erased image, the processor 181 determines that the sheet P is not discharged in a state where the face with the large information amount of the erased image is directed upward if the reversion unit 16 is not operated.

When the erasing process target sheet P is the both-face printed sheet P, the processor 181 determines which one of the sheet faces P1 and P2 is the sheet face with the large information amount of the erased image, based on the information of the sheet faces P1 and P2. Specifically, the processor 181 compares the information amount (1−I2/I1) of the erased image of the sheet P1 with the information amount (1−I2/I1) of the erased image of the sheet P2, and determines that the sheet face with the large information amount of the erased image is the sheet face with the large information amount of the erased image. When the sheet face P2 is larger than the sheet face P1 in terms of information amount of the erased image, the processor 181 determines that the sheet P is discharged in a state where the sheet face with the large information amount of the erased image is directed upward even when the reversion unit 16 is not operated. When the sheet face P1 is larger than the sheet face P2 in terms of information amount of the erased image, the processor 181 determines that the sheet P is not discharged in a state where the sheet face with the large information amount of the erased image is directed upward if the reversion unit 16 is not operated.

In Act 41, when the processor 181 determines that the sheet P is discharged in a state where the sheet face with the large information amount of the erased image is directed upward (Yes), the operation of the image erasing apparatus 100 proceeds to Act 18. In other words, when the processor 181 determines that the sheet face P2 is the face with the large information amount of the erased image, the operation of the image erasing apparatus 100 proceeds to Act 18. In Act 18, the processor 181 allows the flapper F1 to swing clockwise. The flapper F1 guides the sheet P transported by the transport unit 15, and discharges the sheet P to the reuse tray 17*a*. Accordingly, the reuse tray 17*a* accommodates the sheet P in a state where the face (the sheet face P2) with the large erased print amount of the discharged sheet P is directed upward.

In Act 41, when the processor 181 determines that the sheet P is not discharged in a state where the sheet face with the large information amount of the erased image is directed upward (No), the operation of the image erasing apparatus 100 proceeds to Act 42. In other words, when the processor 181 determines that the sheet face P1 is the face with the large information amount of the erased image, the operation of the image erasing apparatus 100 proceeds to Act 42. In Act 42, the processor 181 operates the reversion unit 16. The reversion unit 16 reverses the sheet faces P1 and P2. After the sheet P is reversed, the operation of the image erasing apparatus 100 proceeds to Act 18. In Act 18, the processor 181 allows the flapper F1 to swing clockwise. The flapper F1 guides the sheet P transported by the transport unit 15, and discharges the sheet P to the reuse tray 17*a*. Accordingly, the reuse tray 17*a* accommodates the sheet P in a state where the face (the sheet face P1) with the large erasable print amount of the discharged sheet P is directed upward.

As described above, the image erasing apparatus 100 of the second embodiment scans the sheet P, and accommodates the sheet P determined to be reusable in the reuse tray 17*a* based on the read information of the sheet faces P1 and P2. In addition, the image erasing apparatus 100 accommodates the sheet P determined to be reusable in the reuse tray 17*a* in a state where the sheet face with the large information amount of the erased image is directed upward (the stack direction). Accordingly, the user can visibly and easily determine that the image of the sheet P in the reuse tray 17*a* is erased and the sheet P is reusable.

In addition, when the erasing process target sheet P is the both-face printed sheet P, the image erasing apparatus 100 of the second embodiment determines that the sheet P is reusable when it is recognized that one sheet face is reusable and when it is recognized that both sheet faces are reusable. The image erasing apparatus 100 accommodates the sheet P determined to be reusable in the reuse tray 17*a* in a state where the sheet face with the large information amount of the erased image is directed upward (the stack direction). Accordingly, the user can visibly and easily determine that the sheet P in the reuse tray 17*a* is reusable.

In addition, the image erasing apparatus 100 accommodates the sheet P determined not to be reusable in the reject tray 17*b* in a state where the sheet face with the small information amount of the erased image is directed upward (the stack direction). Since the sheet face with the small information amount of the erased image in the non-reusable sheet P accommodated in the reject tray 17*b* is directed upward (the stack direction), the user can visibly and easily determine that the sheet P in the reject tray 17*b* is not reusable.

In addition, according to the image erasing apparatus 100 of the second embodiment, the user sees the sheet P accommodated in the reuse tray, and can recognize that the image of the sheet P could be erased. In addition, the user sees the sheet P accommodated in the reject tray, and can recognize that the image of the sheet P is not erased.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. An image erasing apparatus that erases an image printed on a sheet, comprising:

an erasing unit configured to erase the image printed on a face of the sheet;

a reading unit configured to read information on the face of the sheet;

a stack unit configured to accommodate the sheet on which an erasing process has been performed by the erasing unit;

a reversion unit configured to reverse the face of the erasing-processed sheet before the sheet is accommodated by the stack unit; and a control unit configured to determine an erasing state of the image on the face of the sheet based on the information on the face of the sheet read by the reading unit, and to control the reversion unit to reverse the face of the sheet according to the determined erasing state of the image.

2. The image erasing apparatus according to claim 1, wherein the control unit determines whether the image is erased as the erasing state of the image, determines that the sheet is reusable when the image is erased, and determines that the sheet is not reusable when the image is not erased.

3. The image erasing apparatus according to claim 2, wherein the stack unit includes a reuse tray that accommodates the sheet determined to be reusable by the control unit, and a reject tray that accommodates the sheet determined not to be reusable by the control unit, and the reuse tray and the reject tray accommodate the sheet on which the erasing process has been performed by the erasing unit by stacking the sheet in a predetermined direction.

4. The image erasing apparatus according to claim 3, wherein when the sheet is reusable, the control unit determines whether the erasing-processed sheet is accommodated by the reuse tray in a state where the face of the sheet with a large information amount of the erased image is directed in the stack direction.

5. The image erasing apparatus according to claim 4, wherein the control unit controls the reversion unit not to reverse the face of the sheet when the erasing-processed sheet is accommodated by the reuse tray in a state where the face of the sheet with a large information amount of the erased image is directed in the stack direction.

6. The image erasing apparatus according to claim 4, wherein the control unit controls the reversion unit to reverse the face of the sheet when the erasing-processed sheet is not accommodated by the reuse tray in a state where the face of the sheet with a large information amount of the erased image is directed in the stack direction.

7. The image erasing apparatus according to claim 3, wherein when the sheet is not reusable, the control unit determines whether the erasing-processed sheet is accommodated by the reject tray in a state where the face of the sheet with a small information amount of the erased image is directed in the stack direction.

8. The image erasing apparatus according to claim 7, wherein the control unit controls the reversion unit not to reverse the face of the sheet when the erasing-processed sheet is accommodated by the reject tray in a state where the face of the sheet with a small information amount of the erased image is directed in the stack direction.

9. The image erasing apparatus according to claim 7, wherein the control unit controls the reversion unit to reverse the face of the sheet when the erasing-processed sheet is not accommodated by the reuse tray in a state where the face of the sheet with a small information amount of the erased image is directed in the stack direction.

10. The image erasing apparatus according to claim 3, wherein when the sheet is reusable, the sheet is reversed such that the erasing-processed sheet is accommodated by the reuse tray in a state where the face of the sheet with a large information amount of the erased image is directed in the stack direction, and when the sheet is not reusable, the sheet is reversed such that the erasing-processed sheet is accommodated by the reject tray in a state where the face of the sheet with a small information amount of the erased image is directed in the stack direction.

* * * * *